US005378978A

United States Patent [19]

Gallo et al.

[11] Patent Number: 5,378,978

[45] Date of Patent: Jan. 3, 1995

[54] SYSTEM FOR CONTROLLING AN ELECTROSTATIC PRECIPITATOR USING DIGITAL SIGNAL PROCESSING

[75] Inventors: Frank Gallo, Wanaque, N.J.; Jean-Francois Vicard, Lyon, France

[73] Assignee: Belco Technologies Corp., Parsipany, N.J.

[21] Appl. No.: 42,354

[22] Filed: Apr. 2, 1993

[51] Int. Cl.[6] ..... G05F 1/455; B03C 3/68

[52] U.S. Cl. ..... 323/241; 323/903; 96/23; 96/21; 96/32

[58] Field of Search ..... 323/903, 2, 241–243, 323/246; 55/101, 105; 363/85, 86, 128; G05F 1/455

[56] References Cited

U.S. PATENT DOCUMENTS

| | | | |
|---|---|---|---|
| 3,641,740 | 2/1972 | Schumann et al. | 55/105 |
| 3,648,437 | 3/1972 | Bridges | 55/105 |
| 3,772,853 | 11/1973 | Burge et al. | 55/105 |
| 3,877,896 | 4/1975 | Muskovac | 55/105 |
| 3,893,828 | 7/1975 | Archer | 55/104 |
| 3,959,715 | 5/1976 | Canning | 323/19 |
| 3,981,695 | 9/1976 | Fuchs | 55/138 |
| 3,984,215 | 10/1976 | Zucker | 55/2 |
| 4,138,233 | 2/1979 | Masuda | 55/139 |
| 4,147,972 | 4/1979 | Hochstetter | 323/24 |
| 4,152,124 | 5/1979 | Davis | 55/105 |
| 4,160,202 | 7/1979 | James et al. | 323/24 |
| 4,209,306 | 6/1980 | Feldman et al. | 55/2 |
| 4,233,039 | 11/1980 | Schmidt | 55/139 |
| 4,284,417 | 8/1981 | Reese et al. | 55/2 |
| 4,290,003 | 9/1981 | Lanese | 323/241 |
| 4,308,494 | 12/1981 | Gelfand et al. | 323/242 |
| 4,318,152 | 3/1982 | Weber | 361/92 |
| 4,354,152 | 10/1982 | Herklotz et al. | 323/241 |
| 4,354,860 | 10/1982 | Herklotz et al. | 55/105 |
| 4,390,830 | 6/1983 | Laugesen | 323/237 |
| 4,410,849 | 10/1983 | Ando | 323/237 |
| 4,413,225 | 11/1983 | Donig et al. | 323/246 |
| 4,432,061 | 2/1984 | Herklotz et al. | 364/480 |
| 4,433,281 | 2/1984 | Herklotz et al. | 323/246 |
| 4,445,911 | 5/1984 | Lind | 55/2 |
| 4,486,704 | 12/1984 | Gustafsson et al. | 323/246 |
| 4,587,475 | 5/1986 | Finney, Jr. et al. | 323/241 |
| 4,605,424 | 8/1986 | Johnston | 55/2 |
| 4,659,342 | 4/1987 | Lind | 55/2 |
| 4,996,471 | 2/1991 | Gallo | 323/241 |
| 5,068,811 | 11/1991 | Johnston et al. | 323/241 X |

*Primary Examiner*—Emanuel T. Voeltz
*Attorney, Agent, or Firm*—Pennie & Edmonds

[57] ABSTRACT

A system for controlling an electrostatic precipitator adapted to be powered by an alternating power source includes a regulator for regulating at least one precipitator operating parameter in response to at least one control signal, a measurement circuit coupled to the precipitator for providing measurement signals corresponding to at least precipitator secondary voltage and precipitator secondary current. A processor coupled to the measurement circuit and to the regulator generates the control signals. The processor is operable to sample successive discrete values of the measurement signals corresponding to secondary voltage and secondary current during an individual half cycle of the alternating power source, to determine present precipitator operating conditions based on at least the sampled values, to predict precipitator operating conditions for the next half cycle of the alternating power source based on at least the present operating conditions, and to selectively vary the at least one control signal by the next half cycle of the alternating power source in response to the predicted operating conditions.

64 Claims, 7 Drawing Sheets

SYSTEM FOR CONTROLLING AN ELECTROSTATIC PRECIPITATOR USING DIGITAL SIGNAL PROCESSING

BACKGROUND OF THE INVENTION

The present invention relates to a system for controlling an electrostatic precipitator by using digital signal processing and, in particular, to the control of the precipitator in response to at least its secondary voltage and secondary current in an individual half cycle of an alternating power source.

Known control means for detecting precipitator operating conditions employ averaging techniques whereby the precipitator power is cycled, i.e., increased and reduced, during many half cycles of an alternating power source to ascertain a characteristic voltage-current response for the precipitator secondary. When the characteristic response is ascertained, the precipitator power is adjusted to provide optimal precipitation. However, since the characteristic response is always changing based on varying operating conditions in the precipitator, periodically the cycling must be repeated looking for a change in the characteristic response. If a change has occurred, the power must be adjusted in response thereto.

A disadvantage of the averaging technique discussed above is that it requires numerous half cycles to ascertain the characteristic voltage-current response for the precipitator. Since it is a goal of precipitation to operate the precipitator at a power level as high as possible without causing strong back corona or excessive sparking, the averaging technique leads to inefficiency because the precipitator may be required to spend numerous half cycles operating under inefficient conditions.

For example, a back corona condition occurs in a precipitator when particulate matter or dust forms on at least one plate of the electrostatic precipitator such that a continuous breakdown of the dust layer occurs. This breakdown is analogous to that occurring at the discharge electrode and similarly produces ion-electron pairs. The positive ions flow across the interelectrode region toward the discharge electrode. The net effect is a reduction of charge on the particles and poor precipitation. During such a condition, the current being supplied to the precipitator plate becomes consumed in the back corona instead of being used to precipitate the suspended gas particles.

The prior art technique for responding to the undesirable back corona condition is to employ the averaging technique described above to detect the point at which voltage no longer increases while current continues to increase and to reduce the current sufficiently so as to operate the precipitator at or below this point. By reducing the current sufficiently, the back corona condition is minimized so that power flowing to the precipitator is used for precipitating particulate matter rather than to feed the back corona. However, since an averaging technique is employed, the system is required to spend numerous half cycles operating in the inefficient back corona area.

Another example of the inefficiencies associated with the prior art techniques is in the control of precipitator rapping. Rapping is generally used to remove collected dust or particulate matter from the precipitator plates. As dust increases on precipitator plates, the resistivity of the plates, including the dust layer, also increases. This increase in resistivity can occur rapidly and increases the probability of sparking. In known control means, rapping is usually a function of time, gas flow or opacity, but not the electrical conditions in the precipitator such as resistivity. As a result, known control means are not able to rapidly identify and respond to fast changing resistivity conditions in the precipitator.

Accordingly, there is the need for a precipitator control system that responds dynamically to precipitator operating conditions, such as back corona, during each half cycle of an alternating power source and that is capable of adjusting the precipitator drive and other precipitator operating parameters in response to such conditions following each half cycle.

SUMMARY OF THE INVENTION

In accordance with the illustrative embodiments demonstrating features and advantages of the present invention, there is provided a system for controlling an electrostatic precipitator adapted to be powered by an alternating power source. The system includes means for regulating at least one precipitator operating parameter in response to at least one control signal.

The system also includes measurement means coupled to the precipitator for providing measurement signals corresponding to at least precipitator secondary voltage and precipitator secondary current. A processing means coupled to the measurement means and to the means for regulating generates the control signals. The processing means is operable to sample successive discrete values of the measurement signals corresponding to secondary voltage and secondary current during an individual half cycle of the alternating power source, to determine present precipitator operating conditions based on at least the sampled values, to predict precipitator operating conditions for the next half cycle of the alternating power source based on at least the present operating conditions, and to selectively vary said at least one control signal by the next half cycle of the alternating power source in response to the predicted operating conditions.

The various operating parameters that are regulated can include the amount of electrical power connected between the power source and the precipitator, the duty cycle of a precipitator operating in an intermittent energization mode, precipitator rapping action, precipitator gas conditioning, precipitator hopper action, precipitator sonic horn activation, ramp rate, spark sensitivity, spark SCR cutback and SCR conduction angle.

The means for regulating the above mentioned operating parameters can include a power modulator for regulating the amount of power connected between the alternating power source and the precipitator during each half cycle of the power source in response to said at least one control signal applied to the power modulator's control terminal. The power modulator can include thyristors (silicon controlled rectifier "SCRs") wherein said at least one control signal establishes a conduction angle for the thyristors for the next half cycle. A change in the control signal represents a new set point for the amount of power delivered to the precipitator by the next half cycle.

The means for regulating can also include a rapping controller, a gas conditioning controller, a hopper controller and a sonic horn controller, all for regulating corresponding operating parameters. Like the power modulator, these other means for regulating are responsive to corresponding control signals.

As noted above, based on the present precipitator operating conditions, the processing means of the present invention is operable to predict future precipitator operating conditions and take appropriate action by varying the control signals. Two methods of prediction are described herein although many will be obvious to those skilled in the art.

In a first, "simple" prediction method, the processing means predicts operating conditions for the next half cycle by assuming that the operating conditions in the next half cycle will be the same as those in the present half cycle. Consequently, when an operating condition exceeds a predetermined limit during a half cycle, the appropriate control signals are varied in a predetermined relationship as described herein.

Alternatively, the processing means is capable of predicting future operating conditions based on trends (the "trend" prediction method) determined via examination of operating conditions during the present half cycle and a predetermined number of previous half cycles. To realize such a method, the processing means is further operable to store information representative of present precipitator operating conditions for numerous half cycles. The stored information can include at least the sampled value. The processing means is then operable to predict operating conditions for the next half cycle based on trends discerned from the operating conditions in the present and a predetermined number of previous half cycles. Thus, when a trend reveals that operating conditions exceed predetermined limits, appropriate control signals are varied according to predetermined relationships as described herein.

It should be clear that since the second ("trend") prediction method considers not only present half cycle information but previous half cycle information as well, it results in more accurate predictions. Thus, in the second embodiment the predetermined limits can be selected closer to actual optimal conditions.

An example of the prediction methods can be considered with regard to a back corona condition. A back corona condition exists when there is a reduction (or no increase) in precipitator voltage at the same time during a half cycle as an increase in precipitator current. While it is not desirable to operate in a strong back corona region, it is also not desirable to operate too far therefrom since high power is critical to efficient precipitation. Thus, being able to predict future precipitator operating conditions becomes critical in maintaining the highest possible power while avoiding strong back corona.

As is discussed in more detail below, by examining the voltage and current samples for an individual half cycle the processing means can detect an operating condition such as a back corona. When the "simple" model is employed, it is assumed that the same condition will occur in the next half cycle. Therefore, if the back corona condition is strong in a given half cycle, the processing means will vary the control signals to reduce power by the next half cycle. Similarly, if the sampled values indicate the precipitator is operating too far from a back corona condition during the present half cycle, the processing means will increase power.

When the "trend" model is employed, the rate of increase of the back corona condition, for example, can be discerned and used to predict the conditions in the next half cycle. If the rate of increase predicts too high a back corona condition in the next half cycle, the control signals can be appropriately varied. Similarly, the processing means would increase power if the precipitator would be operating too far from a back corona condition during the next half cycle.

In addition to varying control signals based on predicted conditions, the processing means is also operable to vary said at least one control signal in response to present unpredicted operating conditions. In the event of an unpredicted condition such as excessive sparking, the processing means is further operable to determine the existence of such an unpredicted condition at any point during the present half cycle and to generate, during the present half cycle, a control signal indicating the unpredicted condition. Means are provided for immediately terminating power flow to the precipitator in response thereto.

The discrete values of precipitator voltage and current can also be used by the processor to ascertain peak power during an individual half cycle of the alternating power source. This information can be used by the processor during intermittent energization (a pattern of ON and OFF half cycles) to determine the optimal power during the ON half cycles and to ascertain an optimal duty cycle (ratio of ON cycles to OFF cycles) for intermittent energization. Additionally, resistance at peak power can be calculated via ohm's Law for each half cycle. An accelerated increase in resistance from one half cycle to the next may indicate increasing dust build up and may therefore require the processing means to initiate certain action, such as rapping, at an earlier time interval then scheduled.

Furthermore, the point at which peak voltage is attained during an individual half cycle may be used to limit the input power to obtain maximum collection efficiency at the minimum operating power level. Maximum collection efficiency can be obtained by adjusting the power for each half cycle for the least current input when dV/dt is at 0. As a result, power consumption is maintained during normal operation, non intermittent energization mode, to the minimum needed for maximum collection. Wasted power is defined by the amount of current necessary above the voltage dV/dt zero point to ascertain the peak voltage. The wasted power is a function of the sampling frequency of the system.

The sampled voltage and current information gathered during each individual half cycle can also be used to control various other aspects of the precipitator's operation. By calculating the area encompassed by an x,y plot of the rising and falling voltage versus current of a half cycle and using the average dV/dt and di/dt of the rising and falling edge of the plot, a value indicative of the dynamic ash resistivity of the precipitator can be determined. This value can be used by the processing means to dynamically set various operating parameters (e.g., ramp rate, spark sensitivity, spark SCR cutback, rapping rate) and adapt to changing conditions of a precipitator. These changing conditions include flue gas temperature, gas volume and fuel mix. By detecting these changes during each half cycle and adapting to these changes, the present invention provides adaptive tuning based on changing process conditions.

The measurement means may also include generating additional measurement signals corresponding to precipitator temperature, gas volume, gas composition, precipitator primary current and a plurality of other conditions well know to those skilled in the art. These additional measurement signals may also be used to determine precipitator operating conditions.

Furthermore, when determining precipitator operating conditions numerous values in addition to the sampled values of secondary current and voltage and the measurement signals can be considered. The additional values can include: the duty cycle of a precipitator operating in intermittent energization, i.e., the ratio of ON half cycles to OFF half cycles; the amount of power delivered to the precipitator, and/or the sampled successive discrete values of the secondary voltage and current for a predetermined number of previous half cycles; the set-points of the operating parameters; and status information regarding the regulating means. Status information can include identifying the previous half cycle during which at least one of the means for regulating was last activated or the future half cycle during which at least one of the means for regulating is next set to be activated. By considering these additional inputs, the system is better adapted to control the multiplicity of precipitator operating parameters discussed above.

The above-described system can be employed for both wet and dry electrostatic precipitation. The system can also include means for reproducing the precipitator voltage and current for an individual half cycle from the discrete values such that the precipitator current and voltage for any time period during a half cycle can be ascertained. The means for reproducing can be a central monitoring unit that can display present and previous voltage and current half cycle information at the request of a user.

Further, the system of the present invention can include multiple precipitation fields either controlled by the same or independent processing means. When independent processing means are employed, the operating conditions and set-point information of at least one field can be shared with at least one other field.

DETAIL DESCRIPTION OF THE PREFERRED EMBODIMENTS

Figure 1:
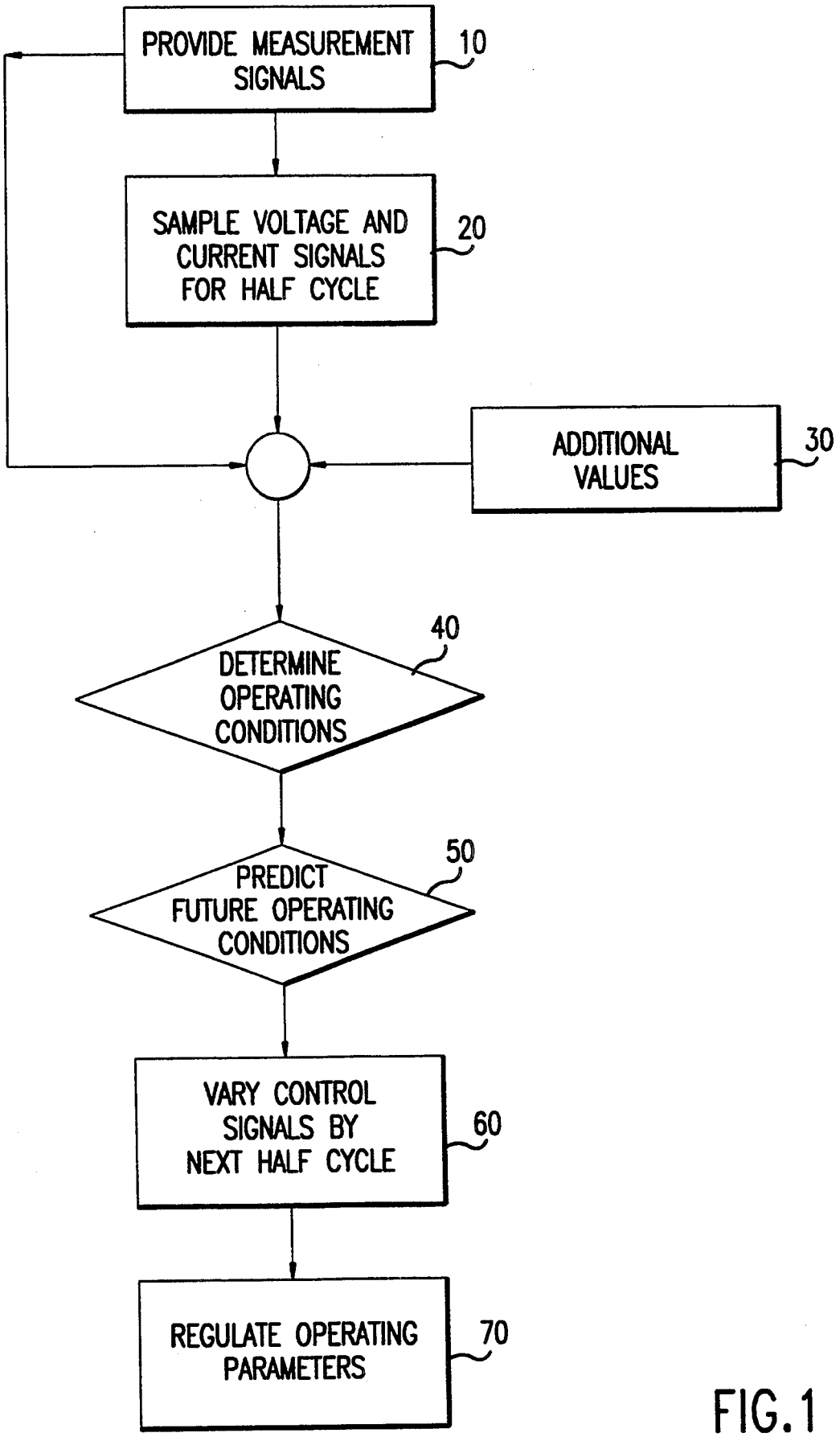
FIG. 1 is a flow chart illustrating the basic processing steps of the present invention.

FIG. 1 depicts the basic processing steps of the preferred embodiment of the present invention for an individual half cycle of an alternating power source. Step 10 involves providing measurement signals corresponding to a plurality of conditions within the precipitator including precipitator secondary voltage and secondary current, precipitator primary current, precipitator gas volume, precipitator gas composition and precipitator temperature. The measurement signals are not limited to the above and can include other precipitator conditions that are known and understood by those skilled in the art.

In step 20, the measurement signals corresponding to secondary voltage and current are discretely sampled preferably 256 times for the individual half cycle. Higher or lower sampling frequencies may be used. Based on the sampled values generated in step 20; the measurement signals provided in step 10; and additional values (discussed below) provided in step 30, present precipitator operating conditions are determined in step 40. These operating conditions can include ash resistivity and a back corona condition.

In step 50 the present precipitator operating condition as well as precipitator operating conditions in a predetermined number of previous half cycles are employed to predict precipitator operating conditions in the next half cycle. The precipitator operating conditions from the previous half cycles should include at least the sampled voltage and current information.

Alternatively, prediction can be based on assuming that operating conditions in the next half cycle will be the same as the present operating conditions without regard to previous half cycles.

In responses to predicted precipitator operating conditions, a plurality of precipitator control signals are varied (step 60) by the next half cycle of the alternating power source. The control signals, in turn, represent set-points to which a plurality of precipitator operating parameters are regulated to in step 70.

The operating parameters include the amount of power connected between power source and precipitators; precipitator rapping action; precipitator gas conditioning; precipitator hopper action; precipitator sonic horn activation; ramp rate; spark sensitivity; spark SCR cutback; SCR conduction angle; and the duty cycle of a precipitator operating in an intermittent energization mode.

The additional values provided in step 30 include the set-points of the operating parameters, sampled voltage and current information for previous half cycles, the amount of power delivered to the precipitator in previous half cycles and status information regarding the various regulating devices.

Figure 2:
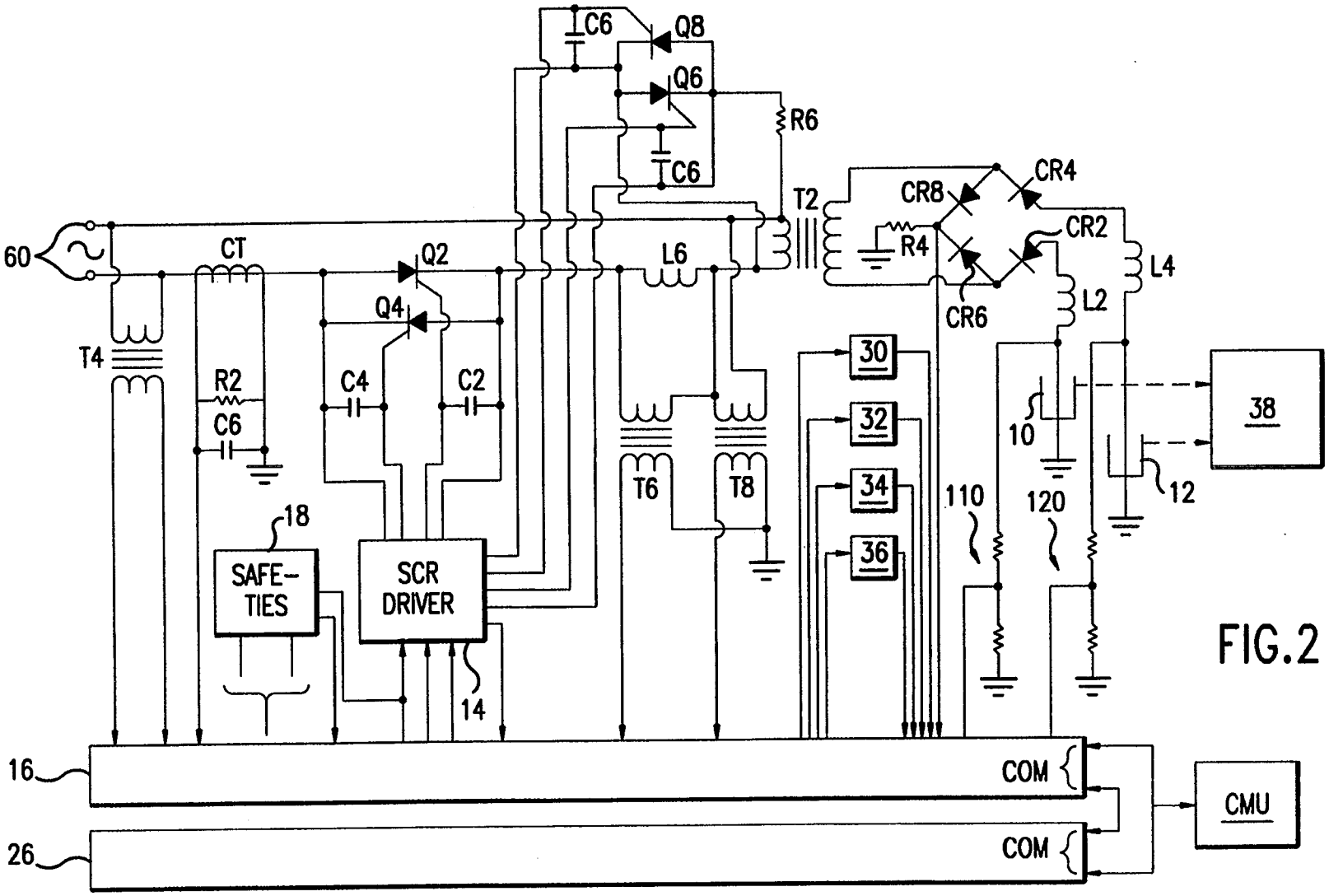
FIG. 2 is a schematic diagram of a precipitator and its associated control system in accordance with principles of the present invention.

FIG. 2 is a schematic diagram of a precipitator and its associated control system in accord with the principles of the present invention. Referring to FIG. 2, a pair of precipitators 10 and 12 are shown connected between ground and one of the terminals of inductors L2 and L4, respectively. The other terminals of inductors L2 and L4 are separately connected to the anodes of rectifiers CR2 and CR4, respectively, or alternatively (not represented), commonly connected to the anodes of rectifiers CR2 and CR4. The cathodes of rectifiers CR2 and CR4 connect to the anodes of rectifiers CR6 and CRS, respectively, whose cathodes are commonly connected through resistor R4 to ground. The anodes of rectifiers CR6 and CR8 separately connect to the secondary of transformer T2, whose primary is serially connected to alternating power source 60 through inductor L6 and an anti-parallel combination of gate turn-off thyristors (SCRs) Q2 and Q4. In the case of a precipitator designed for high gas velocity, inductor L6 could alternatively be a resistor with low inductance.

Processing means 16 generates a plurality of control signals that represent set-points for various precipitator operating parameters. As noted above, these operating parameters (and others not expressly mentioned herein) will be understood by those skilled in the art and include: the amount of power connected between power source 60 and precipitators 10, 12; precipitator rapping action (including rapper activation and rapping rate); precipitator gas conditioning; precipitator hopper action (emptying); precipitator sonic horn activation; ramp rate; spark sensitivity; spark SCR cutback; SCR conduction angle; and the duty cycle of a precipitator operating in an intermittent energization mode.

Applying the appropriate control signals to the gates of thyristors Q2 and Q4 can cause them to start or stop conducting. Every terminal of thyristors Q2 and Q4 separately connect to outputs of thyristor driver 14. Driver 14 has the appropriate buffers and amplifiers to drive the gates of thyristors Q2 and Q4 through inductor L6 and the anti-parallel combination of thyristors Q2 and Q4. Each of the thyristors Q2 and Q4 has a shunting capacitor C2 and C4, respectively, connected from gate to cathode. Thyristors Q2 and Q4 form a power modulator and comprise the means for regulating the power connected between the power source and the precipitators of the present invention.

Control signals are shown as inputs to driver 14 from processing means 16. One of these control signals is connected to safety circuit 18 to incapacitate driver 14. The safety 18 includes a series of switching elements such as thermal cut-offs located at various heat generating elements. Each of these safeties can be enabled by enabling signals from processing means 16, which will be described in further detail hereinafter.

Additional control signals from processing means 16 are shown as inputs into rapping controller 30, hopper controller 32, gas conditioning controller 34 and sonic horn controller 36. A control signal applied to rapping controller 30, for example, can be employed to establish a new rapping rate or to initiate rapping. The detailed operation of these controllers is well understood by those skilled in the art. However, it should be noted that the sonic horn functions to remove dust from precipitator plates via fixed or variable frequency sound waves operating at a variable duty cycle. The sonic horn can be used in conjunction with, or independently from, rappers.

Connected in parallel across current transformer CT are resistor R2 and capacitor C6, which provide a primary current signal to processing means 16. Another two inputs to processing means 16 separately connect to the alternating power lines 60 through signal transformer T4. Similarly, signal transformers T6 and T8 connect the voltage across inductor L6 and the primary of transformer T2 to separate inputs of processor means 16.

The secondary current through the bridge comprising rectifiers CR2–CR8 flows through resistor R4 whose voltage is provided as an input to processing means 16. Since the resistance of resistor R4 is known, this voltage signal is a measure of the current in the secondary of transformer T2. Also, precipitators 10 and 12 are in parallel with resistive voltage dividers 110 and 120, respectively, whose taps separately connect to inputs of processing means 16 providing secondary voltage information. As a result, measurement signals corresponding to secondary current and voltage are provided to the processing means 16.

Additional measurement signals are provided to the processing means by a plurality of measurement devices indicated collectively as 38. These measurement signals are conventionally produced and include precipitator gas volume, precipitator gas composition and precipitator temperature.

Processing means 16 can independently control the power delivered to precipitators 10 and 12 and may be constructed substantially as described in U.S. Pat. No. 4,996,471, the disclosure of which is expressly incorporated herein by reference. The conduction angle of thyristors Q2 and Q4 establishes the power delivered through transformer T2. For example, during one half cycle, thyristor Q2 can be kept off until a certain phase angle is reached, at which point a pulse is applied to its gate to turn the thyristor on for the balance of the half cycle. In the next half cycle, a similar operation can be performed with respect to thyristor Q4. It will be appreciated, however, that thyristors Q2 and Q4 can also be turned off before the end of a half cycle. This turn-off can be done to regulate precipitator power finely or to respond to a catastrophic event such as sparking or a strong back corona condition. Accordingly, if an unpredicted, severe back corona condition or spark is detected, processing means 16 immediately terminates conduction by the thyristors.

As an alternative to thyristors Q2 or Q4 for accomplishing turn-off in the event of severe, unpredicted conditions, the SCR driver 14 can immediately turn on the appropriate one of a second pair of anti-parallel thyristors Q6 and Q8 fitted with shunting capacitors C6 and C8 and resistor R6 as shown in FIG. 2. Components Q6, Q8, C6, C8 and R6 make up a commutation circuit which is connected to transformer T2 and is designed to short circuit the transformer T2 for the duration of the half cycle during which the severe, unpredicted condition occurs. Other arrangements of commutation circuits will be understood by those skilled in the art and could include arrangements for short circuiting source 60 or short circuiting the transformer on the secondary side.

Processing means 16 is adapted to store the conduction angle of the thyristors for a plurality of half cycles. A predetermined number of these stored values can be used by the processing means in determining precipitator operating conditions and predicting future precipitator operating conditions. For instance, if a trend of continually increasing conduction angles is observed without a corresponding increase in power at the precipitators, an unacceptable dust level at the precipitators may be indicated.

Additionally, software can be provided to cause intermittent energization by gating the thyristors at a desired duty cycle, i.e., a given number of ON half cycles followed by a given number of OFF half cycles (zero power via a zero conduction angle). One scheme for providing intermittent energization is disclosed by U.S. Pat. No. 4,587,475 to Finney, Jr. et al., the disclosure of which is expressly incorporated herein by reference.

As disclosed in FIG. 2 of the above-incorporated U.S. Pat. No. 4,996,471, the processing means is timed by an interrupt means that produces signals of various frequencies locked in phase with the alternating current source. These signals are timing signals which processing means 16 needs in order to monitor and control the precipitator. In particular, the timing signals tell the processing means 16 when to sample the various operating parameters of the precipitator. The processing means 16 is adapted to take up to 256 samples of the various measurement signals over each half cycle of the AC source. In the preferred embodiment of the present invention, the interrupt means is arranged to provide a timing signal at a frequency of 30,720 Hz to establish the 256 sampling points in each half cycle of a 60 Hz source. These timing signals are used by the interrupting means to initiate an interrupt handler.

Of particular importance to the present invention are the sampled secondary current and sampled secondary voltage for each half cycle of the alter-hating current since these values provide a good measure of precipitator operating conditions. For example, under normal conditions, as the secondary current increases, the secondary voltage will likewise increase. However, during a back corona condition, the secondary voltage decreases (or remains equal) as the secondary current increases. This is due to the consumption of current by the back corona. By monitoring the waveforms in each half cycle of an alternating current source, the processing means can determine, for example, if too strong a back corona condition, or a condition close to a back corona, is present. By assuming that conditions during the next half cycle would be similar if the control signals are not varied, i.e., employing the "simple" prediction method, the processing means is operable to dynamically vary the control signals to rapidly respond to such a condition. A typical response to a strong back corona condition could, for example, be to vary the control signals to reduce the SCR conduction angle for the next half cycle.

Figure 3:
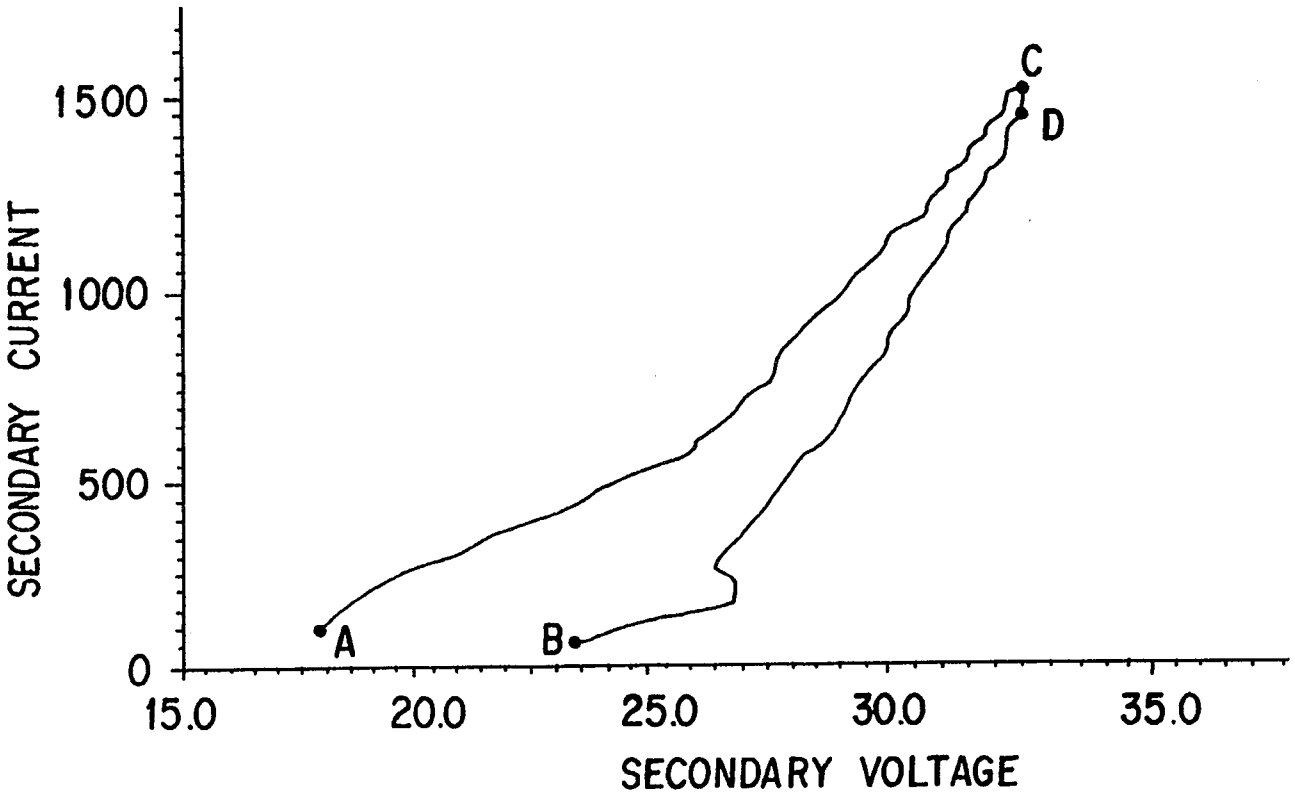
FIG. 3 is a plot of secondary voltage and secondary current for an individual half cycle of an alternating power source.

An illustrative dynamic plot of secondary current versus secondary voltage for an individual half cycle of the alternating current source is shown in FIG. 3. The half cycle progresses in time from point A to point B. As can be seen from the plot, the secondary current and the secondary voltage both increase until point C, after which the current decreases. After point D the voltage begins to decrease. As such, no back corona is indicated by this plot.

Figure 4:
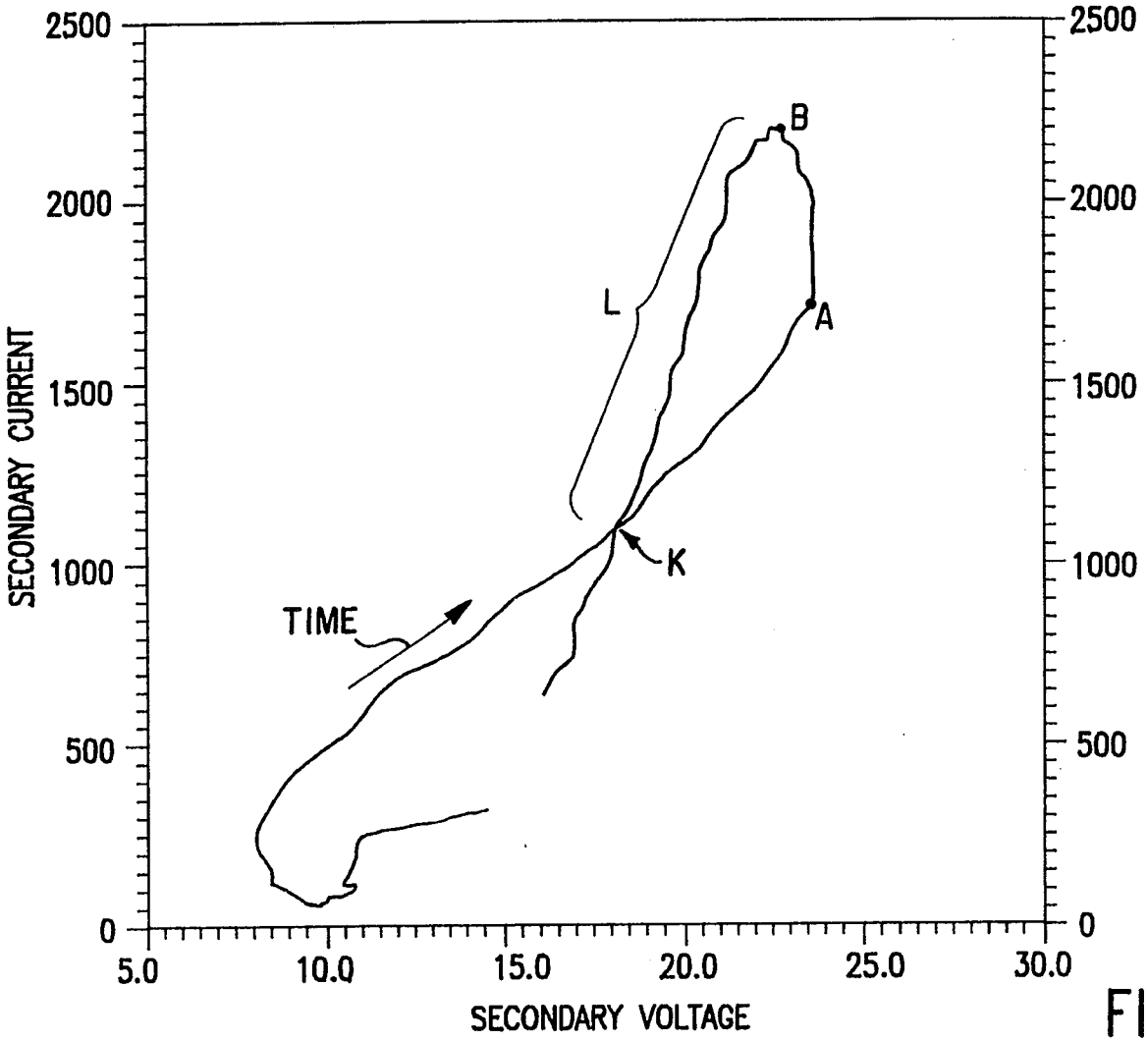
FIG. 4 is a plot of secondary voltage and secondary current for an individual half cycle of an alternating power source exhibiting a high back corona condition.

Alternatively, FIG. 4 illustrates a dynamic secondary current versus secondary voltage plot during a half cycle operating in a strong back corona condition. In the early stages of the half cycle the voltage and current increase simultaneously until a maximum voltage is reached at point A. When the maximum voltage is reached, a strong back corona condition is occurring until the maximum current (point B) is reached. This is indicated by the strong current increase with no voltage increase and some voltage decrease. The back corona condition then reduces. Since an increase in current during a period of no increase and/or a decrease in voltage will necessarily result in a crossing point K in a voltage-current curve of this type, a back corona condition can conveniently be revealed by such a crossing point K of the upward and downward voltage sections of the curve. Additionally, a dynamic V-I curve of this type will have a loop L with a crossing point K when a back corona condition exists.

Figure 5:
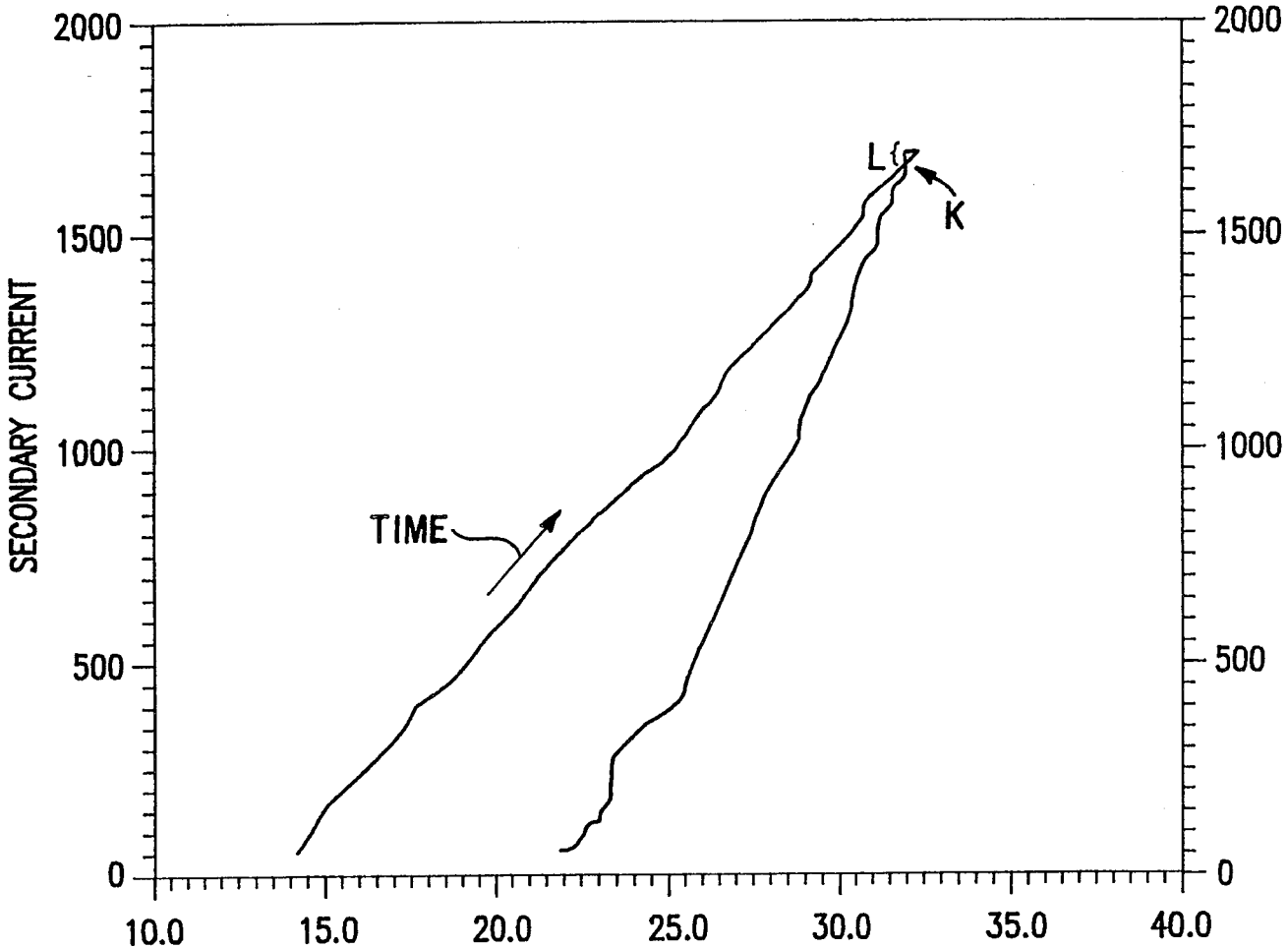
FIG. 5 is a plot of secondary voltage and secondary current for an individual half cycle of an alternating power source exhibiting a low back corona condition.

A first method for controlling a back corona condition is shown in FIG. 5 and involves minimizing the size of the loop L around crossing point K by keeping the difference between maximum current and the current at the crossing point K below a predetermined value or by keeping the difference between maximum voltage and voltage at the crossing point K below a predetermined value. As such, FIG. 5 exhibits a low back corona condition.

Figure 6:
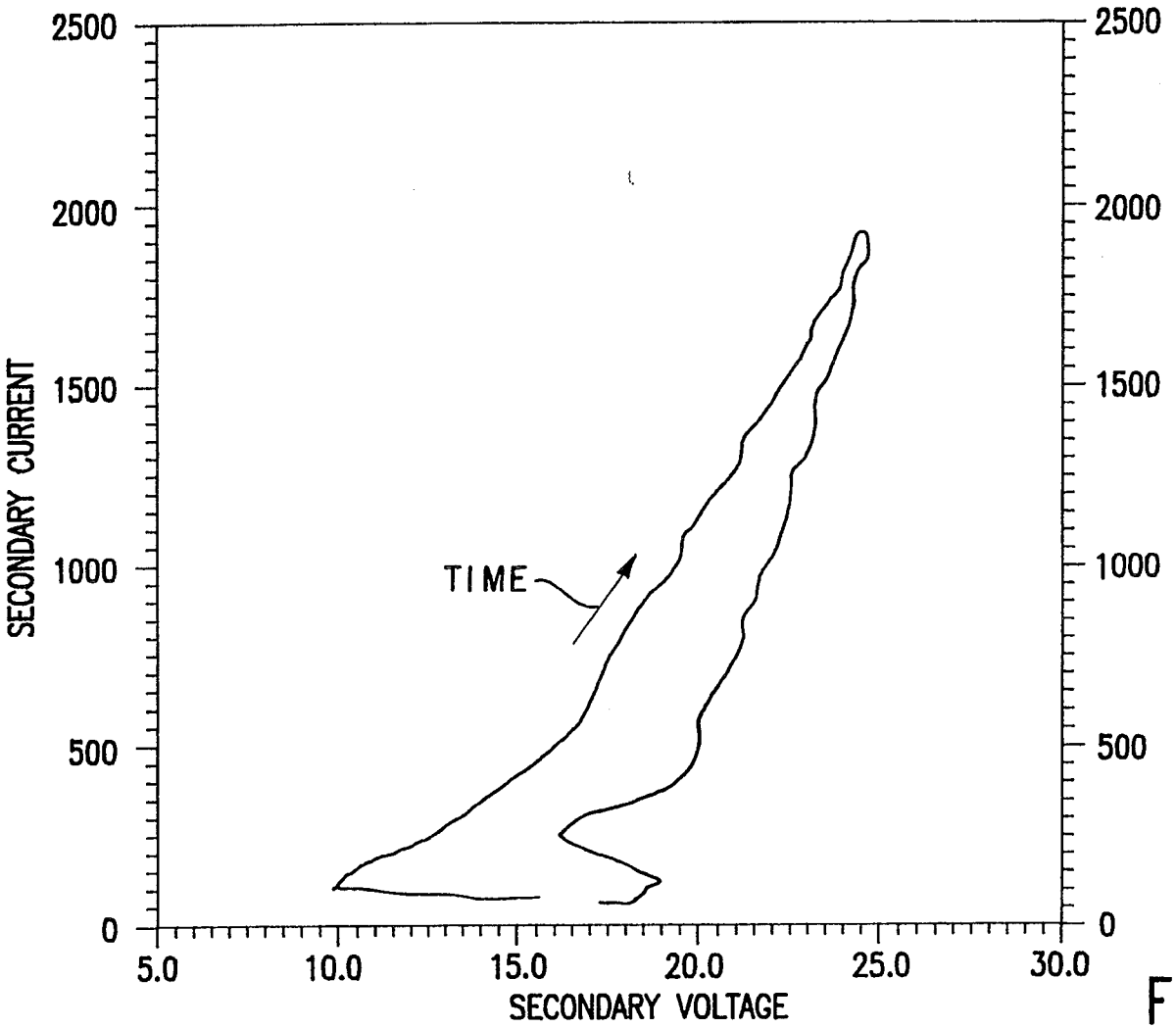
FIG. 6 is a plot of secondary voltage and secondary current for an individual half cycle of an alternating power source exhibiting a condition close to back corona.
Figure 7:
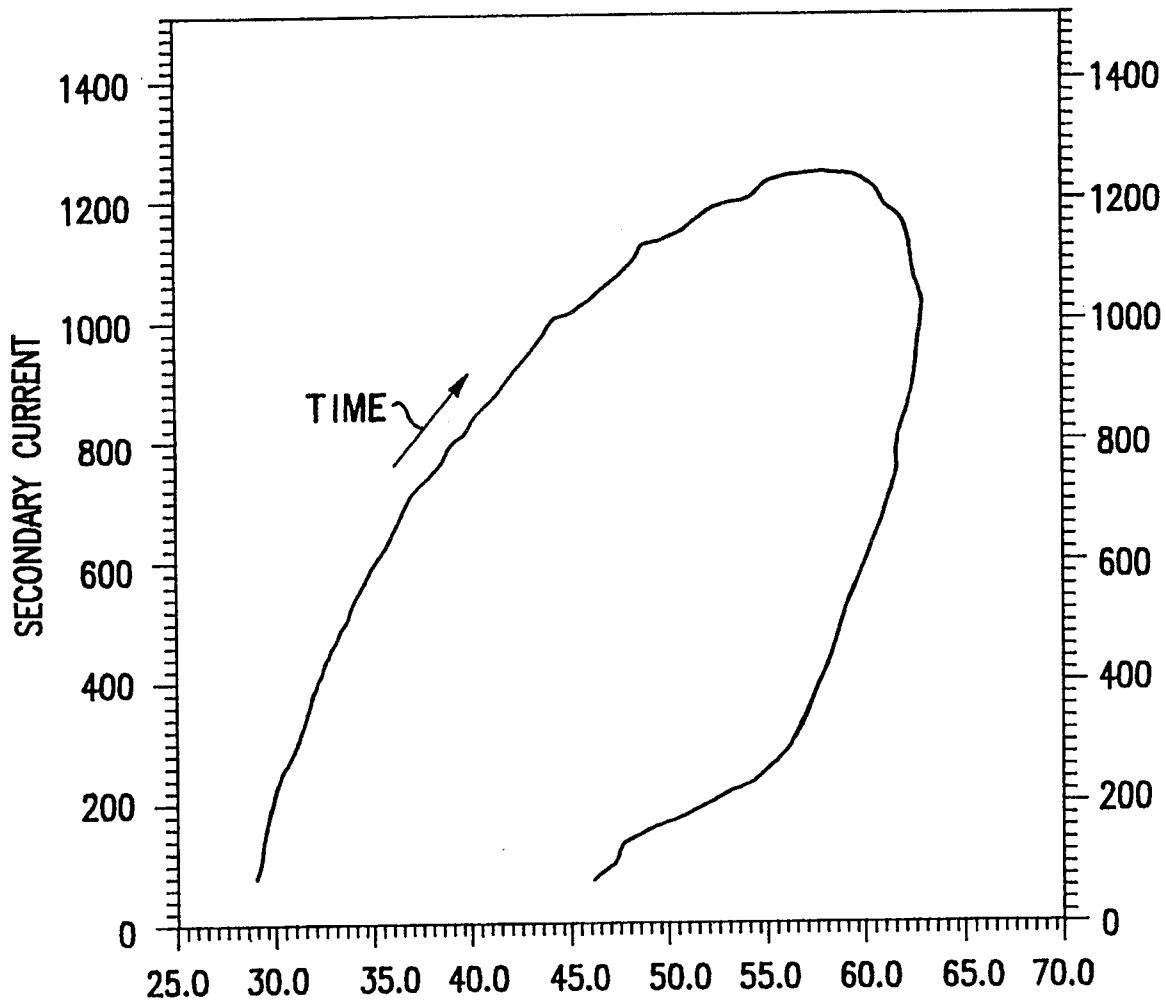
FIG. 7 is a plot of secondary voltage and secondary current for an individual half cycle of an alternating power source exhibiting a condition far from back corona.

Alternatively, as shown in FIG. 6, a second preferred method to control back corona is to prevent the occurrence of the back corona condition by keeping above a predetermined value the difference between the maximum voltage, i.e., the point where $dV/dt=0$, and the voltage corresponding to the same current as the maximum voltage point but on the upward portion of the curve. As can be observed from FIG. 6, there is no crossing point K and thus no back corona condition. However, as indicated by the closeness of the upward and downward portions of the curve, i.e., the "thinness" of the curve, near the maximum current area, the system is operating at an efficiently high power level close to back corona. In contrast, FIG. 7 shows a condition far from back corona as indicated by the distance between the upward and downward portions, i.e., no thinness. Such a system is operating at an undesireably low power level.

With either one of these methods for controlling back corona (FIG. 5 or 6), the "simple" or "trend" prediction schemes can be employed. When the simple method is employed, only the present half cycle is examined. When the trend method is employed, conditions in previous half cycles as well can be considered allowing for tighter control.

The processing means 16 also stores the sampled voltage and current waveforms of the type depicted in FIGS. 3–7 for a plurality of half cycles. In determining precipitator operating conditions and predicting future conditions, a predetermined number of these stored half cycles can be used. By examining the voltage and current waveforms for several previous half cycles, a trend may be observed predicting a particular operating condition that is not evident from the individual half cycle and is likely to occur during the next half if the control signals are not varied. In response to such predicted, unacceptable conditions, the processing means is operable to vary the control signals dynamically by the next half cycle of the alternating power source.

The processing means is also programmed to consider a plurality of additional values when determining precipitator operating conditions. These include, the measurement signals discussed above; the set points of the operating parameters; status information regarding the various regulating devices; and the duty cycle of a precipitator operating in an intermittent energization mode.

The status information of the regulating devices can include identifying the previous half cycle during which one of the devices was last activated or the future half cycle during which at least one is next set to be activated, e.g., the half cycle during which rapping last occurred or is next set to occur. By considering all of these inputs, the processing means 16 is adapted to more efficiently determine precipitator operating conditions than if only secondary voltage and current were considered.

An example of employing various values or inputs to react to precipitator operating conditions can be illustrated in connection with the handling of dust build-up on the precipitator plates. As is known in the art, during operation dust increases in thickness on the collecting plates of the precipitator. When the dust becomes too thick, inefficient conditions in the precipitator such as back corona and sparking can result. In accord with the present invention, to monitor the dust level and determine when conditions become unacceptable, the resistance of the precipitator at peak power during individual half cycles can be determined via the sampled voltage and current information as described below. As long as this resistance is within a predetermined acceptable range from half cycle to half cycle, no action will be taken. When the resistance has increased past a predetermined point during a particular half cycle, thereby indicating too thick a dust level, appropriate control signals can be adjusted to initiate rapping or sonic horn action by the next half cycle.

Additionally, if a second value or input to the processing means indicates that rapping was performed in the half cycle immediately prior, additional control signals can be adjusted effecting other precipitator control parameters. For example, the amount of power delivered to an upstream precipitator field can be increased in response to such conditions. Further, if proper conditions are still not reestablished, other set points can be changed such as gas conditioning and/or intermittent energization parameters.

When in an intermittent energization mode, the measurement signal corresponding to precipitator secondary voltage can be employed to determine when the secondary voltage drops below a predetermined value during OFF half cycles (the secondary voltage will exponentially decay during OFF half cycles due to the capacitance of the precipitator plate). This value can be based on the minimum voltage required for efficient precipitation. When the predetermined value is reached, the processing means is programmed to initiate ON half cycles by the next half cycle of the power supply.

As noted above, certain precipitator operating conditions can be determined from the dynamic voltage-current plot as shown in FIG. 4. In addition to the back corona condition discussed above, it has been found that the difference between the voltage ending point B and the voltage starting point A is indicative of the precipitator's dynamic ash resistance. The ash resistance of a precipitator varies with changing process conditions such as precipitator fuel gas temperature, gas volume or fuel mix. Since it is necessary to modify the precipitator's operating parameters that are sensitive to these changing conditions, e.g., ramp rate, spark sensitivity, spark SCR cutback, in response to these changing conditions, measurement of the dynamic ash resistance allows the processing means 16 to dynamically adjust to the changing conditions each half cycle.

Also, from the curve in FIG. 3, the processing means is able to determine the peak power for any given half cycle. This is indicated by point C and represents the maximum of the product of secondary current and secondary voltage. If the system can be operated at peak power while the precipitator is kept out of the undesirable back corona area, maximum efficiency can be achieved. To this end, a "Peak Seek" technique (gradual increase of the current to find the optimal operating conditions) can be employed over the average values of current and voltage for many half cycles. In accordance with the invention, a "Peak Seek" technique can be used to monitor the peak power for each half cycle. If the peak power decreases from one half cycle to the next, the processing means is alerted it has reached or passed the point of optimal drive. In an identical fashion, peak power can also be used to determine the optimal duty cycle when intermittent energization is employed.

Furthermore, the point at which peak voltage is attained may be used to limit the input power to obtain maximum collection efficiency at the minimum operating power level. This point may be adjusted each half cycle for the least current input when dV/dt is at 0 (point C of FIG. 3). This would reduce power consumption during normal operation, non pulsing mode, to the minimum needed for maximum collection. Wasted power would be defined by the amount of current necessary above the voltage dV/dt zero point needed to ascertain the peak voltage. The wasted power is a function of the sampling frequency of the system, and of the minimum variation of the SCR firing angle.

Processing means 16 is enhanced with communications capability as indicated by its interconnected communications ports COM. Port COM is also shown communicating to allied processor 26. Processor 26 can be identical to processing means 16 and can be used to control another precipitator field (not shown) that is upstream (or downstream) from precipitators 10 and 12. Alternatively, processing means 16 can control both fields. Additionally, when a single processing means is employed, the operating conditions and the set points of the operating parameters of one field can be inputted into a second field. Thus, conditions at a downstream field can be used to control precipitation at an upstream field. For instance, if conditions at an downstream field require rapping more often than typically required, this may indicate that excessive dust is being collected in the downstream field and that too little dust is being collected at an upstream field. To remedy this, the collection at the upstream field may have to be increased by, for example, increasing power to that field.

The communications from port COM can be in the form of serial data bits using the RS-232 or other protocol. Data is exchanged with a central monitoring unit (CMU) shown connected to the communications ports COM of processors 16 and 26. The CMU can be a personal computer that is programmed to send and receive data from processors 16 and 26. For example, the CMU can receive data signifying operating parameters measured by processing means 16. These various operating parameters can be displayed on a CRT (not shown) in the CMU. Thus, a remote operator can monitor all significant parameters associated with precipitators 10 and 12 and its transformer-rectifier.

Also, the waveforms of the various monitored operating parameters can be displayed at the CMU. For example, the CMU can display the secondary voltage measurements from divider 110 and the secondary current measurements as represented by the voltage across R4 that are sampled and collected at successive times during a half cycle of power line 60, as discussed in detail below. After collecting data samples, communications port COM of processing means 16 can transmit the samples in a burst to the CMU. The CMU can assemble the data and display them graphically as a wave form.

Processing means 16 is designed such that it can transmit the data representing the secondary voltage and secondary current waveforms for an individual half cycle after the half cycle has ended. Furthermore, processing means 16 is capable of storing the discretely sampled values for several half cycles of the alternating current and later sending one or more of the previously sampled waveforms to the CMU on demand from a user.

Since dynamic values and average values can be calculated internally through the program of processing means 16, discrete analog integrators are unnecessary for filtering data.

Obviously, many modifications and variations of the present invention are possible in light of the above teachings. It is therefore to be understood that within the scope of the appended claims, the invention may be practiced otherwise than as specifically described.

We claim:

1. A system for controlling an electrostatic precipitator adapted to be powered by an alternating power source comprising:

means for regulating at least one precipitator operating parameter in response to at least one control signal;

measurement means coupled to the precipitator for providing measurement signals corresponding at least to precipitator secondary voltage and precipitator secondary current; and processing means coupled to the measurement means and to the means for regulating for generating said at least one control signal, said processing means operable to sample successive discrete values of the measurement signals corresponding to secondary voltage and secondary current during an individual half cycle of the alternating power source, to determine present precipitator operating conditions based on at least the sampled values, to predict precipitator operating conditions for the next half cycle of the alternating power source based on at least the present operating conditions, and to selectively vary said at least one control signal by the next half cycle of the alternating power source in response to the predicted operating conditions.

2. The system of claim 1 wherein said processing means predicts operating conditions for the next half cycle by assuming that the operating conditions in the next half cycle will be the same as the present precipitator operating conditions.

3. The system of claim 1 wherein said processing means is further operable to store information representative of present precipitator operating conditions.

4. The system of claim 3 wherein said processing means predicts operating conditions for the next half cycle based further on trends in operating conditions determined from a predetermined number of half cycles of the stored information.

5. The system of claim 4 wherein the stored information includes at least the sampled values.

6. The system of claim 4 wherein said processing means selectively varies said at least one control signal further in response to the present operating conditions.

7. The system of claim 6 wherein said processing means is further operable to determine an unpredicted condition at any point during the present half cycle and to generate, during the present half cycle, a control signal indicating the unpredicted condition.

8. The system of claim 7 wherein the means for regulating includes antiparallel gate turn off thyristors that can be immediately turned off during the present half cycle in response to the control signal indicating the unpredicted condition.

9. The system of claim 7 further including a transformer in series between the electrostatic precipitator and the alternating power source and further including commutation means operable to immediately short-circuit the transformer in response to the control signal indicating the unpredicted condition.

10. The system of claim 7 wherein the unpredicted conditions include at least one of the following: excessive sparking and strong back corona.

11. The system of claim 4 wherein the means for regulating includes thyristors and wherein said at least one control signal establishes a conduction angle for the thyristors for the next half cycle.

12. The system of claim 11 wherein said processing means determines present precipitation operating conditions based further on the conduction angle for the present half cycle.

13. The system of claim 12 wherein said processing means is further operable to store information indicative of the next half cycle conduction angle and wherein said processing means determines present precipitator operating conditions based further on a predetermined number of half cycles of the stored information.

14. The system of claim 1 wherein said at least one operating parameter includes the amount of electrical power connected between the power source and the precipitator during each half cycle of the power source.

15. The system of claim 14 wherein the means for regulating the amount of electrical power connected between the power source and the precipitator is a power modulator having a control terminal, the power modulator responsive to said at least one control signal applied to the control terminal.

16. The system of claim 15 wherein the precipitator is operated in an intermittent energization mode and wherein said at least one operating parameter includes the duty cycle of the intermittent energization.

17. The system of claim 16 wherein the power modulator further regulates the pattern of ON and OFF half cycles.

18. The system of claim 17 wherein said processing means determines present precipitator operating conditions based further on the duty cycle.

19. The system of claim 17 wherein said processing means is further operable to determine when the secondary voltage has fallen below a predetermined point during OFF half cycles.

20. The system of claim 19 wherein said at least one control signal is varied so as to initiate ON half cycles in response to the determination that the secondary voltage has fallen below the predetermined point.

21. The system of claim 14 wherein said processing means is further operable to store values representative of the power connected between the power source and the precipitator for a plurality of individual half cycles, and wherein said processing means determines present precipitator operating conditions based further on a predetermined number of half cycles of the stored values.

22. The system of claim 1 wherein said at least one precipitator operating parameter includes at least one of the following: precipitator rapping action, precipitator gas conditioning, precipitator hopper action, precipitator sonic horn activation, ramp rate, spark sensitivity and spark SCR cutback.

23. The system of claim 22 wherein a plurality of said at least one control signal represent set points of each precipitator operating parameter and wherein said processing means determines present precipitator operating conditions based further on the set points.

24. The system of claim 22 wherein said processing means is further operable to store values representative of the set points for a plurality of individual half cycles, and wherein said processing means determines present precipitator operating conditions based further on a predetermined number of half cycles of the stored values.

25. The system of claim 23 wherein the means for regulating includes at least one of the following: a rapping controller, a gas conditioning controller, a hopper controller and a sonic horn controller, each having a control terminal, said controllers operable in response to said at least one control signal applied to the control terminal to regulate a corresponding operating parameter.

26. The system of claim 25 wherein said processing means is further operable to determine status information of at least one of the means for regulating, and wherein the processing means determines present precipitator operating conditions based further on the status information.

27. The system of claim 26 wherein the status information includes identifying the previous half cycle during which at least one of the means for regulating was last activated.

28. The system of claim 26 wherein the status information includes identifying the future half cycle during which at least one of the means for regulating is next set to be activated.

29. The system of claim 1 wherein said processing means is further operable to store the sampled successive discrete values of the secondary voltage and the secondary current measurement signals for a plurality of individual half cycles.

30. The system of claim 29 wherein said processing means determines present precipitator operating conditions based further on a predetermined number of half cycles of the stored measurement signals.

31. The system of claim 1 wherein the measurement signals additionally correspond to at least one of the following process conditions: precipitator gas volume, precipitator gas composition, precipitator temperature, precipitator primary current, and wherein present precipitator operating conditions are based further on at least one of the measurement signals.

32. The system of claim 1 comprising at least two precipitation fields controlled by independent processing means.

33. The system of claim 32 wherein said at least one control signal represents set points of the precipitator operating parameters.

34. The system of claim 33 wherein one of said independent processing means determines present precipitator operating conditions based further on the operating conditions and the set points of the operating parameters of at least one of the other fields.

35. The system of claim 1 comprising at least two precipitation fields controlled by the same processing means.

36. The system of claim 1 wherein the precipitator operating conditions include a back corona condition and wherein a back corona condition is determined from the sampled values when there are two points during an individual half cycle having the same voltage and current values.

37. The system of claim 14 wherein the precipitator operating conditions include a back corona condition, and wherein a back corona condition is determined from the sampled values when there is no increase in precipitator voltage at the same time during a half cycle as an increase in precipitator current.

38. The system of claim 34 wherein in response to a back corona condition, said at least one control signal is varied so as to reduce power to the precipitator by the next half cycle.

39. The system of claim 1 wherein the precipitator operating conditions include ash resistivity, and wherein ash resistivity is determined by measuring the voltage difference between the precipitator voltage at the beginning and end of an individual half cycle.

40. The system of claim 1 wherein the precipitator operating conditions include ash resistivity, and wherein ash resistivity is determined via the time rate change of voltage and the time rate change of current during an individual half cycle.

41. The system of claim 14 wherein the precipitator operating conditions include peak power at the precipitator during an individual half cycle.

42. The system of claim 41 wherein at least one of the control signals is varied such that the amount of electrical power connected between the power source and the precipitator is not significantly greater than that required to maintain peak power at the precipitator.

43. The system of claim 41 wherein the peak power at the precipitator is determined based on the greatest value of the product of the voltage and current for each discrete sample during an individual half cycle.

44. The system of claim 43 wherein a value representative of precipitator plate resistance is determined from the sampled values of voltage and current at peak power of an individual half cycle via ohm's law.

45. The system of claim 44 wherein, in response to an increase in plate resistance from one half cycle to the next greater than a predetermined value, at least one of said at least one control signal is varied by the next half cycle so as to reduce resistance.

46. The system of claim 45 wherein said at least one varied control signal at least initiates rapping.

47. The system of claim 14 wherein an optimal power level at the precipitator is determined based on the product of the sampled value for voltage and current at the time during the half cycle when the time rate change of voltage becomes zero.

48. The system of claim 47 wherein the precipitator is operated in an intermittent energization mode and wherein an optimal duty cycle is determined based on the optimal power level at the precipitator.

49. The system of claim 48 wherein the precipitation is operated in an intermittent energization mode and wherein said at least one control signal is varied such that the amount of electrical power connected between the power source and the precipitator during ON half cycles is not significantly greater than that required to maintain the optimal power level at the precipitator.

50. The system of claim 1 further comprising means for reproducing waveforms of the precipitator current and precipitator voltage of individual half cycles from the discrete values such that the precipitator current and precipitator voltage for any time period during the half cycle can be ascertained.

51. The system of claim 50 wherein said means for reproducing is a remote monitoring unit.

52. The system of claim 51 wherein the processing means further comprises means for storing the discrete values.

53. The system of claim 52 wherein the stored discrete values are sent to the remote monitoring unit at the request of a user.

54. The system of claim 1 wherein the electrostatic precipitator is a dry electrostatic precipitator.

55. The system of claim 1 wherein the electrostatic precipitator is a wet electrostatic precipitator.

56. A system for controlling an electrostatic precipitator adapted to be powered by an alternating power source comprising:

means for regulating at least one precipitator operating parameter in response to at least one control signal;

measurement means coupled to the precipitator for providing measurement signals corresponding at least to precipitator secondary voltage and precipitator secondary current; and processing means coupled to the measurement means and to the means for regulating for generating said at least one control signal, said processing means operable to sample successive discrete values of the measurement signals corresponding to secondary voltage and secondary current during an individual half cycle of the alternating power source, to determine present precipitator operating conditions based on at least the sampled values, and to selectively vary said at least one control signal by the next half cycle of the alternating power source in response to the present operating conditions.

57. The system of claim 56 wherein said processing means is further operable to predict precipitator operating conditions for the next half cycle of the alternating power source based on at least the present operating conditions and to selectively vary said at least one control signal further in response to the predicted conditions.

58. The system of claim 57 wherein said processing means predicts operating conditions for the next half cycle by assuming that the operating conditions in the next half cycle will be the same as those in the present half cycle.

59. The system of claim 57 wherein said processing means is further operable to store information representative of present precipitator operating conditions.

60. The system of claim 59 wherein said processing means predicts operating conditions for the next half cycle further based on a predetermined number of half cycles of the stored information.

61. A system for controlling an electrostatic precipitator adapted to be powered by an alternating power source comprising:

means for regulating at least one precipitator operating parameter in response to at least one control signal;

measurement means coupled to the precipitator for providing measurement signals corresponding at least to precipitator secondary voltage and precipitator secondary current; and processing means coupled to the measurement means and to the means for regulating for generating said at least one control signal, said processing means operable to sample successive discrete values of the measurement signals corresponding to secondary voltage and secondary current during an individual half cycle of the alternating power source, to determine future precipitator operating conditions based on at least the sampled values, and to selectively vary said at least one control signal by the next half cycle of the alternating power source in response to the future operating conditions.

62. The system of claim 61 wherein the processing means determines future operating conditions by assuming that the sampled values in the next half cycle will be the same as the sampled values in the present half cycle.

63. The system of claim 61 wherein the processing means is further operable to store information representative of the sampled values.

64. The system of claim 63 wherein the processing means determines future operating conditions based further on trends in operating conditions determined from a predetermined number of half cycles of the stored information.

* * * * *